US011087735B2

(12) United States Patent
Pignier et al.

(10) Patent No.: US 11,087,735 B2
(45) Date of Patent: Aug. 10, 2021

(54) ACTIVE NOISE CONTROL METHOD AND SYSTEM

(71) Applicant: Faurecia Creo AB, Linköping (SE)

(72) Inventors: Nicolas Pignier, Stockholm (SE); Christophe Mattei, Linköping (SE); Robert Risberg, Linköping (SE)

(73) Assignee: Faurecia Creo AB, Linköping (SE)

( * ) Notice: Subject to any disclaimer, the term of this patent is extended or adjusted under 35 U.S.C. 154(b) by 0 days.

(21) Appl. No.: 16/768,011

(22) PCT Filed: Nov. 29, 2018

(86) PCT No.: PCT/EP2018/082980
§ 371 (c)(1),
(2) Date: May 28, 2020

(87) PCT Pub. No.: WO2019/106077
PCT Pub. Date: Jun. 6, 2019

(65) Prior Publication Data

US 2020/0365133 A1 Nov. 19, 2020

(30) Foreign Application Priority Data

Nov. 30, 2017 (SE) ..... 1751476-1

(51) Int. Cl.
*G10K 11/178* (2006.01)

(52) U.S. Cl.
CPC .. *G10K 11/17881* (2018.01); *G10K 11/17817* (2018.01); *G10K 11/17854* (2018.01);
(Continued)

(58) Field of Classification Search
CPC ..... G10K 11/17813; G10K 11/17817; G10K 11/17825; G10K 11/17854;
(Continued)

(56) References Cited

U.S. PATENT DOCUMENTS 5,226,016 A 7/1993 Christman
5,359,662 A 10/1994 Yuan et al.
(Continued)

FOREIGN PATENT DOCUMENTS

DE 102015214134 A1 2/2017
EP 0684594 A2 11/1995
(Continued)

OTHER PUBLICATIONS

International Search Report for International Application No. PCT/EP2018/082980, dated Apr. 1, 2019 (15 pages).
(Continued)

*Primary Examiner* — Kile O Blair
(74) *Attorney, Agent, or Firm* — Kagan Binder, PLLC

(57) ABSTRACT

A method for reducing the power of an acoustic primary noise signal ($d_m(n)$) at one or more control positions in a vehicle passenger compartment using an adaptive filter. The method comprising to compare a mean correlation coefficient ($\gamma_m(n)$) between an electrical error signal ($e_m(n)$ and a modelled secondary anti-noise signal $\hat{y}_m(n)$ with at least one predefined threshold ($\alpha$, $\beta$).

18 Claims, 5 Drawing Sheets

(52) U.S. Cl.
CPC ..... *G10K 11/17855* (2018.01); *G10K 2210/1282* (2013.01); *G10K 2210/3026* (2013.01); *G10K 2210/3027* (2013.01); *G10K 2210/3028* (2013.01); *G10K 2210/3035* (2013.01); *G10K 2210/3044* (2013.01)

(58) Field of Classification Search
CPC ..... G10K 11/17879; G10K 2210/3018; G10K 2210/3022; G10K 2210/30232; G10K 2210/3035; G10K 2210/3055
See application file for complete search history.

(56) References Cited

U.S. PATENT DOCUMENTS

| | | | | |
|---|---|---|---|---|
| 5,689,572 | A | 11/1997 | Ohki et al. | |
| 6,665,410 | B1 | 12/2003 | Parkins | |
| 9,704,471 | B1 | 7/2017 | Ku | |
| 2001/0048740 | A1 | 12/2001 | Zhang et al. | |
| 2002/0097884 | A1 | 7/2002 | Cairns | |
| 2002/0117579 | A1 | 8/2002 | Kotoulas et al. | |
| 2008/0192954 | A1 | 8/2008 | Honji et al. | |
| 2010/0098263 | A1 | 4/2010 | Pan et al. | |
| 2010/0124337 | A1 | 5/2010 | Wertz et al. | |
| 2010/0226501 | A1 | 9/2010 | Christoph | |
| 2011/0305347 | A1 | 12/2011 | Wurm | |
| 2012/0177221 | A1 | 7/2012 | Christoph | |
| 2016/0093283 | A1 | 3/2016 | Kano | |
| 2016/0314778 | A1 | 10/2016 | Christoph et al. | |
| 2017/0178617 | A1 | 6/2017 | Christoph et al. | |
| 2017/0287461 | A1* | 10/2017 | Ku ..... | G10K 11/17833 |
| 2018/0308469 | A1* | 10/2018 | Sugai ..... | G10K 11/17813 |

FOREIGN PATENT DOCUMENTS

| | | | |
|---|---|---|---|
| EP | 2420411 | A1 | 2/2012 |
| EP | 2597638 | A1 | 5/2013 |
| WO | 2017157595 | A1 | 9/2017 |
| WO | 2017157669 | A1 | 9/2017 |

OTHER PUBLICATIONS

Guopin et al., "Improvement of Audio Noise Reduction System Based on RLS Algorithm", Proceedings of 2013 3rd International Conference on Computer Science and Network Technology, pp. 964-968, 2013, (5 pages).
Kahrs et al., "The past, present and future of audio signal processing", IEEE Signal Processing Magazine, pp. 30-57, 1997, (28 pages).
Kuo et al., "Active noise control: A tutorial review", Proceedings of the IEEE, IEEE, vol. 87, No. 6, pp. 943-973, 1999, (31 pages).
Swedish Search Report for Swedish Application No. 1751476-1, dated Jun. 11, 2018 (3 pages).
E-spacenet English Abstract of DE 102015214134.
Swedish Office Action and Search Report for Swedish Application No. 1850077-7, dated Sep. 7, 2018 (8 pages).
Swedish Second Office Action for Swedish Application No. 1850077-7, dated Feb. 22, 2019 (6 pages).
International Search Report and Written Opinion for International Application No. PCT/EP2019/051350, dated Apr. 24, 2019 (15 pages).
Swedish Search Report for Swedish Application No. 1850077-7, dated Jun. 4, 2020 (4 pages).

* cited by examiner

ACTIVE NOISE CONTROL METHOD AND SYSTEM

CROSS-REFERENCE TO RELATED APPLICATIONS

This application claims priority to International Application No. PCT/EP2018/082980, filed Nov. 29, 2018 and titled "ACTIVE NOISE CONTROL METHOD AND SYSTEM," which in turn claims priority from a Swedish Patent Application having serial number 1751476-1, filed Nov. 30, 2017, titled "ACTIVE NOISE CONTROL METHOD AND SYSTEM," both of which are incorporated herein by reference in their entireties.

TECHNICAL FIELD

The present disclosure relates to a method and system for reducing the power of an acoustic primary noise signal at a control position in a vehicle passenger compartment using an adaptive filter.

BACKGROUND OF THE INVENTION

In a motor vehicle disturbing acoustic noise may be radiated into the passenger compartment generated by mechanical vibrations of the engine or components mechanically coupled thereto (e.g., a fan), wind passing over and around the vehicle, or tires contacting, for example, a paved surface.

Active noise control (ANC) systems and methods are known that, in particular for lower frequency ranges, eliminate or at least reduce such noise radiated into a listening room of the passenger compartment.

The basic principle of common ANC systems is to introduce a secondary sound source in the vehicle compartment so as to provide an opposite-phase image, secondary sound field, of the noise, the primary sound field. The degree to which the secondary sound field matches the primary sound field determines the effectiveness of an ANC system. If the primary and secondary sound fields were matched exactly, both in space and time, the noise would be completely eliminated at least in a certain portion of the compartment. In practice, such match cannot be made perfect, and this mismatch limits the degree of noise control which can be achieved.

Modern ANC systems implement digital signal processing and digital filtering techniques. Typically, a noise sensor (e.g., a microphone or a non-acoustical sensor) is used in the compartment to provide an electrical reference signal representing the disturbing noise signal in a certain portion of the compartment. The reference signal is fed to an adaptive filter, which supplies a filtered reference signal to an acoustic transducer (e.g., a loudspeaker), the secondary sound source. The acoustic transducer generates a secondary sound field having a phase opposite to that of the primary sound field to a defined portion of the compartment. The secondary sound field interacts with the primary sound field, thereby eliminating or at least reducing the disturbing noise within the defined compartment portion. The residual noise at this defined portion may be sensed using a microphone. The resulting microphone output signal is used as an "error signal" and is provided to the adaptive filter, wherein the filter coefficients of the adaptive filter are modified such that a norm (e.g., the power) of the error signal and, thereby, the residual noise at the defined portion of the compartment is minimized.

The acoustic transmission path from the noise source to the microphone is usually referred to as a "primary path" of the ANC system. The acoustic transmission path between the loudspeaker and the microphone, a "secondary path". The process for identifying the transmission function of the secondary path is referred to as the "secondary path identification".

The response (i.e., magnitude response and/or phase response) of the secondary path may be subject to variations during operation of the ANC system. A varying transmission function of the secondary path may have a considerable and negative impact on the performance of the active noise control by affecting the convergence behavior of the adaptive filter, and thus the stability and quality of the behavior thereof, and also the adaptation speed of the filter.

Vehicle operative conditions such as change in compartment temperature, number of passengers, open or closed windows or sun roof, may have a negative impact on the secondary path transmission function such that this no longer matches an a priori identified secondary path transmission function that is used within the ANC system. This limits the achievable attenuation performance of an ANC system.

There is a, hence, a general need for ANC systems with selectable cancellation characteristics while maintaining speed and quality of adaption as well as robustness of the active noise control.

SUMMARY OF THE INVENTION

It is an object of the present disclosure to provide an improved method of reducing noise at at least one control position in a passenger vehicle compartment.

It is also an object to provide an improved active noise control system.

The invention is defined by the appended independent claims. Embodiments are set forth in the dependent claims, in the attached drawings and in the following description.

According to a first aspect there is provided a method for reducing the power of an acoustic primary noise signal at one or more control positions in a vehicle passenger compartment, the acoustic primary noise signal originating from an acoustic noise signal transmitted from a noise source through a respective primary sound path to the respective control position. The method comprises, arranging an adaptive filter to receive input signals comprising an electrical reference signal representing the acoustic noise signal, and at least one electrical error signal representing a respective acoustic signal detected by a respective sound sensor at the respective control position, arranging the adaptive filter to provide and transmit at least one electrical control signal to at least one acoustic transducer arranged in the compartment, and arranging the at least one acoustic transducer to, as a response to the at least one electrical control signal, provide and transmit a respective anti-noise signal through a respective secondary sound path between the at least one acoustic transducer and the respective control position, arriving at the at least one control position as a respective acoustic secondary anti-noise signal such as to minimize the respective electrical error signal, and providing a respective modelled secondary anti-noise signal from a respective secondary sound path model. The method further comprises calculating a respective mean correlation coefficient between the respective electrical error signal and the respective modelled secondary anti-noise signal, and comparing at least one of the mean correlation coefficients with at least one predefined threshold, or comparing an average value of the at least one correlation coefficient with at least one predefined threshold.

The above method is a so called active noise control (or cancellation), ANC, method.

With noise source is here meant e.g. wind noise, engine noise, road noise or any combined such noise.

A control position is a position in the compartment at which a suppression of an acoustic noise signal is desired, e.g. a position in the vicinity of an ear of a passenger. At such a position the noise signal should be eliminated or at least reduced. In typical applications, the system comprises several control positions over the heads of the front and rear passengers.

The number of acoustic transducers and sound sensors used in the method may vary between 1 and 10. A typical installation in a car would have between 4 and 6 acoustic transducers and between 4 and 8 sound sensors. The transducers used are arranged to send acoustic signals that minimize the acoustic power at all sound sensors used in the method.

The at least one acoustic transducer may e.g. be a loudspeaker or a shaker.

The at least one sound sensor may e.g. be a microphone.

At a control position a respective sound sensor is arranged to detect a combined sound signal comprising the acoustic primary noise signal and a respective acoustic secondary anti-noise signal. The aim of the acoustic secondary anti-noise signal is to be an opposite-phase image of the acoustic primary noise signal. The degree to which an acoustic secondary anti-noise signal matches the acoustic primary noise signal determines the electrical error signal representing the acoustic signal detected by a sound sensor at a control position. If the acoustic primary noise signal and an acoustic secondary anti-noise signal were matched exactly, both in space and time, the primary noise signal would be completely eliminated at the control position. In practice, such match cannot be made perfect, and this mismatch limits the degree of noise control which can be achieved.

The present method comprises steps of providing a respective modelled secondary anti-noise signal (from respective secondary sound path models). A respective mean correlation coefficient is calculated between the respective electrical error signal and the respective modelled secondary anti-noise signal. At least one of the mean correlation coefficients is compared with at least one predefined threshold, thereby getting an indication of the performance of the method. Alternatively, an average value of the at least one correlation coefficient is compared with the at least one predefined threshold to get an indication of the performance of the method.

If the average value of the mean correlation coefficient(s) or alternatively if any of the mean correlation coefficients is compared with the at least one predefined threshold, different measures may be taken, such as to update filter parameters, exchange transducer(s) and/or sound sensor(s) used in the method, change a modeled secondary anti-noise signal, etc.

A secondary sound path model used to provide a modelled secondary anti-noise signal represents a transfer function between an acoustic transducer and a sound sensor. It may be determined offline (when there is no disturbing acoustic noise signal) in a calibration step, or online (in presence of the disturbing acoustic noise signal), through so-called online secondary path modelling techniques.

Through these method steps there is, hence, a fast and sensitive way of evaluating the performance of the method and based on the comparison of the mean correlation coefficient(s) with the at least one predetermined threshold get an early indication of failure of the method. Failure here meaning that the power of the acoustic primary noise signal is not reduced or not enough reduced at the control position in the vehicle passenger compartment, or alternatively that the method is diverging, resulting in an acoustic control signal with an excessively large amplitude compared to the acoustic primary noise signal.

Reasons for the failure may be that a secondary sound path may be subject to variations during operation of the method. Thereby, the acoustic secondary anti-noise signal at the control position may also be subject to changes. A varying transmission function of the secondary sound path may have a considerable and negative impact on the performance of the active noise control by affecting the convergence behavior of the adaptive filter, and thus the stability and quality of the behavior thereof, and also the adaptation speed of the filter.

Vehicle operation conditions such as change in compartment temperature, number of passengers, open or closed windows or sun roof, may have a negative impact on the secondary path transmission function such that this no longer matches an a priori identified secondary path transmission function (secondary path model) that is used in the ANC method. This limits the achievable attenuation performance of an ANC method.

The mean correlation coefficient(s) is (are) compared with the at least one predefined threshold and a divergence of a correlation coefficient is detectable at an early stage near the onset of the divergence of a secondary anti-noise signal, even before it can be heard at the control position.

Sudden level increases in the background sound field (door closing, music, conversation) may decrease but not increase the amplitude of the correlation coefficient as they are not present in the modelled secondary anti-noise signal.

The electrical reference signal representing the acoustic noise signal may be generated from a non-acoustic sensor measuring e.g. the engine speed, an accelerometer signal etc.

The sound sensor(s) and acoustic transducer(s) used in the method may be units specifically arranged and used for the active noise control. Alternatively, they may also be used e.g. by the audio system of the vehicle and the hands-free communication systems in the vehicle.

A mean correlation coefficient with a value of 0 indicates that the electrical error signal and the modelled secondary anti-noise signal are not correlated. A mean correlation coefficient with a value of 1 indicates that the signals are perfectly correlated.

The mean correlation coefficient $\gamma$ may be computed from a correlation coefficient defined as e.g. the Pearson correlation coefficient (PCC)

$$r = \frac{\mathrm{cov}(e, \hat{y})}{\mathrm{var}(e)\mathrm{var}(\hat{y})}, \tag{1}$$

wherein e is the electrical error signal and $\hat{y}$ is the modelled secondary anti-noise signal. The abbreviations coy and var refer to the covariance and variance of the signals. See for example Benesty, Jacob, et al. "Pearson correlation coefficient. Noise reduction in speech processing." Springer Berlin Heidelberg, 2009. 1-4, for further details of the Pearson correlation coefficient.

Alternative definitions of the correlation coefficient could be used, for example based on the concept of wavelet coherence. See Jean-Philippe Lachaux, Antoine Lutz, David Rudrauf, Diego Cosmelli, Michel Le Van Quyen, Jacques Martinerie, Francisco Varela, Estimating the time-course of coherence between single-trial brain signals: an introduction to wavelet coherence, In Neurophysiologie Clinique/Clinical Neurophysiology, Volume 32, Issue 3, 2002, Pages 157-174, ISSN 0987-7053, https://doi.org/10.1016/S0987-7053(02)00301-5, for details.

r may be evaluated over a moving time frame using the values $$\{e(n), e(n-1), \ldots, e(n-N+1); \hat{y}(n), \hat{y}(n-1), \ldots, \hat{y}(n-N+1)\} \text{ as} \tag{2}$$

$$r(n) = \frac{\sum_{i=0}^{N-1} (e(n-i) - \text{mean}(e))(\hat{y}(n-i) - \text{mean}(\hat{y}))}{\sqrt{\sum_{i=0}^{N-1} (e(n-i) - \text{mean}(e))^2} \sqrt{\sum_{i=0}^{N-1} (\hat{y}(n-i) - \text{mean}(\hat{y}))^2}} \tag{3}$$

where $$\text{mean}(e) = 1/N \sum_{i=0}^{N-1} e(n-i) \tag{4}$$

and with a corresponding definition for $\hat{y}$. The index n refers to the value of the variable at the current time step. N is the number of samples over which r is evaluated. Typically, N would be in the range 100-10000. A larger N results in a more accurate determination of the correlation coefficient r, whereas a smaller N makes it more reactive to time evolutions of the signals. The mean correlation coefficient $\gamma$ is then computed from the value of r and its past history using the recursive relation $$\gamma(n) = \frac{1}{1+\eta}(\eta\phi(r(n)) + \gamma(n-1)), \tag{5}$$

where $\eta \ll 1$ is an update coefficient determining the contribution of the current correlation coefficient r to the mean value $\gamma(n)$. A typical value for $\eta$ would be in the range of 0.0001-0.01. $\phi$ may be a function of the form $\phi(x)=|x|^a$ or alternatively $\phi(x)=x^a$, where a is a positive integer. a affects the sensitivity of the mean correlation coefficient to small variations of r. A typical value for a would be 1 or 2.

The mean correlation coefficient $\gamma$ thus defined is robust to abrupt changes in the secondary sound path, which would occur when the geometry of the environment is suddenly changed. The sudden increase of r during the time it takes for the adaptive filter to adapt to the new conditions is moderated by the coefficient $\eta$ in the evaluation of $\gamma$.

Providing a modelled secondary anti-noise signal may comprise passing an electrical reference signal consecutively through a secondary sound path model and then through the digital filter of the adaptive filter.

Alternatively, providing a modelled secondary anti-noise signal may comprise passing an electrical reference signal consecutively through the digital filter of the adaptive filter and then through a secondary sound path model.

The secondary sound path model may be obtained offline, in a calibration step, using secondary path system identification techniques. It may also be obtained online using so-called online secondary path modelling techniques.

A mean correlation coefficient at a current time step may be calculated as a function of a correlation coefficient at the current time step and a mean correlation coefficient at a previous time step, wherein a correlation coefficient is calculated from the N last samples of an error signal and a modelled secondary anti-noise signal, wherein the number of samples N is in the range of 100-10000, preferably 500-5000.

If an amplitude of at least one mean correlation coefficient or an amplitude of the average value of the at least one mean correlation coefficient is smaller than a first threshold value $\alpha$, this may indicate an optimally performing method, wherein the first threshold value $\alpha$ is in the range of 0.01-0.3, preferably 0.05-0.2.

When an amplitude of a mean correlation coefficient or an amplitude of the average value of a mean correlation coefficient is smaller than $\alpha$ this indicates that the filter used is working optimally or at least close to optimally. The acoustic secondary anti-noise signal(s) then contributes fully to reduce the acoustic primary noise at the control position(s). The electrical error signal(s) is (are) then weakly correlated with the secondary anti-noise signal(s).

If at least one mean correlation coefficient or the average value of the at least one mean correlation coefficient is larger than or equal to a second threshold value $\beta$, this may be indicative of a diverging method, wherein the second threshold value $\beta$ is in the range of 0.4-0.9, preferably 0.5-0.8.

If at least one of an amplitude of the mean correlation coefficients or an amplitude of the average value of the at least one mean correlation coefficient is larger than or equal to a second threshold value, this may be indicative of a diverging method, wherein the second threshold value may be in the range of 0.4-0.9, preferably 0.5-0.8.

When a mean correlation coefficient or the average value of a mean correlation coefficient is larger than or equal to $\beta$, this indicates that the filter used in the method is not adapted and that there is a divergent behavior of the adaptive filter. The acoustic secondary anti-noise signal(s) is (are) then larger in amplitude than required to cancel the acoustic primary noise at the control position(s) and the electrical error signal(s) is (are) highly correlated with the acoustic secondary anti-noise signal(s).

If an amplitude of at least one mean correlation coefficient or an amplitude of the average value of the at least one mean correlation coefficient is larger than or equal to a first threshold value $\alpha$ and at least one of mean correlation coefficient or the average value of the at least one mean correlation coefficient is smaller than a second threshold value $\beta$, this is indicative of a non-optimally performing method, wherein the first threshold value $\alpha$ is in the range of 0.01-0.3, preferably 0.05-0.2, and the second threshold value $\beta$ is in the range of 0.4-0.9, preferably 0.5-0.8.

If an amplitude of the at least one mean correlation coefficient or an amplitude of the average value of the at least one mean correlation coefficient is larger than or equal to a first threshold value $\alpha$ and at least one of an amplitude of the mean correlation coefficients or an amplitude of the average value of the at least one mean correlation coefficient is smaller than a second threshold value, this may be indicative of a non-optimally performing method, wherein the first threshold value $\alpha$ may be in the range of 0.01-0.3, preferably 0.05-0.2, and the second threshold value $\beta$ may be in the range of 0.4-0.9, preferably 0.5-0.8.

In this situation, it is indicated that the method is performing non-optimally. The acoustic secondary anti-noise signal(s) contribute(s) partially to reducing the acoustic primary noise at the control position(s). The electrical error signal(s) is (are) partially correlated with the secondary anti-noise signal (s). Such situation may occur e.g. if there is a convergence of the method to (a) local minimum(s) that would not provide minimized electrical error signal(s).

If the method is diverging or is performing non-optimally, the method may comprise changing one or more filter parameters chosen from amplitude of step size (μ) sign of step size (μ) phase of step size (μ) and leakage factor.

At least one of the step size (μ) and leakage factor may be changed by multiplication with a correction factor negatively dependent on the amplitude of the mean correlation coefficient.

A recovery rate, may be defined as a positive rate of change, of at least one of a modified step size (μ) and leakage factor. The recovery rate may be limited to a predefined value.

For a single-input single-output leaky-FXLMS algorithm, the coefficients of the adaptive filter may be updated at each time step according to the formula $$w(n+1)=(1-\mu\lambda)w(n)+\mu x'(n)e(n) \tag{6}$$

Where the vectors w and x' are defined as $$w(n)=[w_0(n)\ w_1(n)\ \ldots\ w_{L_w-1}(n)]^T \tag{7}$$

$$x'(n)=[x'(n)\ x'(n-1)\ \ldots\ x'(n-L_w+1)]^T \tag{8}$$

In this formula, $L_w$ is the length of the filter W, μ is the so-called step size and (1-λμ) the so-called leakage factor. If the method is diverging or is performing non-optimally, the amplitude of step size may be reduced by half, the leakage factor may be doubled. When the method is working, they may return to their initial value.

If the method is diverging or is performing non-optimally, the amplitude of the step size may be reduced by a predefined factor or may be reduced dynamically based on a value of the at least one mean correlation coefficient. The leakage factor may be reduced in a similar fashion.

Changing such parameters could improve the behavior of the adaption algorithm of the filter and make it converge to a more optimal solution.

If the method is diverging or is performing non-optimally, the method may comprise changing the secondary sound path model used in the method to a secondary sound path model selected from a set of pre-measured secondary sound path models.

Such secondary path models/transfer functions may be measured or obtained for different operating conditions.

If the method is diverging or is performing non-optimally and two or more sound sensors are used in the method, the method may comprise changing a spatial distribution of acoustic transducers and/or sound sensors in the compartment by switching on or off one or more acoustic transducers and/or sound sensors.

A distribution of acoustic transducers and sound sensors may be spatially optimal for a given noise disturbance, but may not be adapted when the noise disturbance changes or when the conditions in the compartment change. In such case, using a different spatial distribution of acoustic transducers and sound sensors may improve the performance of the system.

Alternatively, a transducer/sensor may not be working properly, for example if it is defective or if it is covered by an object placed in the compartment. In such cases, deactivating it may result in a better control of the sound field.

If the method is not working or is performing non-optimally, the method may comprise a step of stopping the method.

The adaptive filter may be may be updated using a method selected from a group consisting of filtered-x-LMS, leaky filtered-x-LMS, filtered-error-LMS and modified-filtered-x-LMS.

LMS here meaning least mean squares.

The adaption algorithm of the filter may be an algorithm selected from a group consisting of LMS, normalized LMS (NLMS) and recursive least squares (RLS).

Operative conditions and method parameters may be registered in a database when the method is performing optimally.

Vehicle operative conditions may be parameters such as compartment temperature, number of passengers, open or closed windows or sun roof. Method parameters are e.g. the filter parameters used, the secondary path model(s) used. Once all possible vehicle operative parameters conditions are mapped in the database, i.e. when the method is self-learned, the method automatically selects optimal method parameters from the database.

According to a second aspect there is provided an active noise control system for reducing the power of an acoustic primary noise signal at one or more control positions in a vehicle passenger compartment, the acoustic primary noise signal originating from an acoustic noise signal transmitted from a noise source through a respective primary sound path to the respective control position. The system comprises an adaptive filter, which is arranged to take as input signals an electrical reference signal representing the acoustic noise signal, and at least one electrical error signal representing a respective acoustic signal detected by a respective sound sensor at the respective control position, and which adaptive filter is arranged to provide and transmit at least one electrical control signal to at least one acoustic transducer arranged in the compartment, which at least one acoustic transducer in response to the electrical control signal is arranged to provide and transmit a respective acoustic anti-noise signal through a respective secondary sound path between the at least one acoustic transducer and the respective control position, arriving at the at least one control position as a respective acoustic secondary anti-noise signal, such as to minimize the respective electrical error signal. The system further comprises a performance monitoring unit arranged to provide a respective modelled secondary anti-noise signal from a respective secondary sound path model, calculate a respective mean correlation coefficient between the respective electrical error signal and the respective modelled secondary anti-noise signal, and to compare at least one of the mean correlation coefficients with at least one predefined threshold (α, β), or compare an average value of the at least one correlation coefficient with at least one predefined threshold.

DETAILED DESCRIPTION OF THE DRAWINGS

Figure 1:
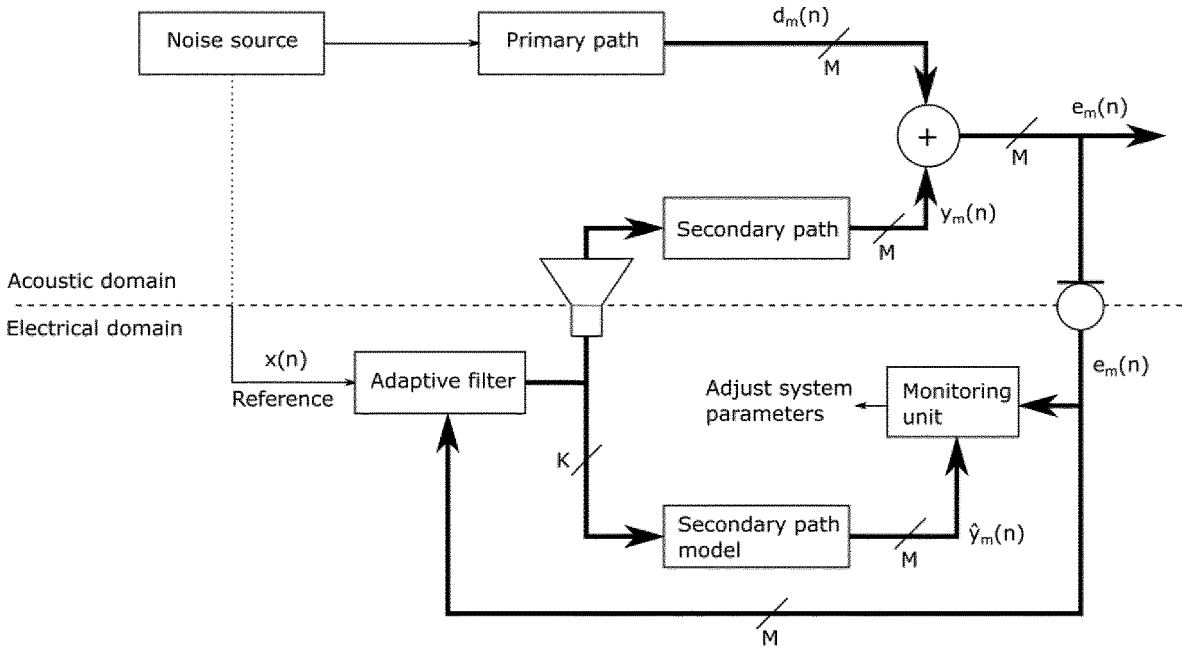
FIG. 1 shows a diagram of an active noise control system equipped with a performance monitoring unit.

FIGS. 1-4 illustrate an active noise control (ANC) system with a performance monitoring unit and also show the corresponding ANC method. Such an ANC system may be used to eliminate or reduce disturbing noise radiated into a vehicle passenger compartment of a motor vehicle from a noise source. Such noise may be generated by mechanical vibrations of an engine and/or components mechanically coupled thereto (e.g., a fan), wind passing over and around the vehicle, and/or tires contacting, for example, a paved surface.

At M control positions, positions at which a suppression of an acoustic noise signal is desired in the vehicle passenger compartment, the power of an acoustic primary noise signal $d_m(n)$ is to be reduced. The acoustic primary noise signal originating from an acoustic noise signal transmitted from a noise source through a respective primary sound path $P_m$ to the control position.

The system comprises M sound sensors, such as a microphone, arranged at the control position in the vehicle compartment, K acoustic transducers, such as loudspeakers, arranged in the vehicle compartment, and an adaptive filter with a digital filter W. The number M of sound sensors and number K of transducers used in the system may be from 1 to 10. Sound sensors and transducers are used all together to reduce the acoustic power at the sound sensors.

The adaptive filter is arranged to take as input signals an electrical reference signal x(n) representing the acoustic noise signal and the electrical error signal(s) $e_m(n)$ (m=1, 2, 3, . . . , M). The electrical error signal $e_m(n)$ representing a respective acoustic signal detected by a respective sound sensor at the control position. The electrical reference signal may be determined from e.g. engine speed, accelerometer signal etc.

The adaptive filter, which may be of the type filtered-x-LMS, leaky filtered x-LMS, filtered-error-LMS or modified-filtered-x-LMS, is arranged to provide and transmit electrical control signal(s) $y'_k(n)$ to the acoustic transducer(s) arranged in the compartment. In response to the electrical control signal(s) $y'_k(n)$ the transducer(s) is (are) arranged to provide and transmit a respective acoustic anti-noise signal $y_m(n)$ through respective secondary sound path(s) $S_{km}$ between the acoustic transducer(s) and the control position, arriving at the control position as a respective acoustic secondary anti-noise signal $y_m(n)$, such as to minimize the respective electrical error signal $e_m(n)$. The filter W is updated to reduce the electrical error signal $e_m(n)$ for example in a least mean square sense by using a known adaption algorithm, e.g., LMS, NLMS, RLS, etc.

At a control position, the respective sound sensor is arranged to detect a combined sound signal comprising the acoustic primary noise signal $d_m(n)$ and the respective acoustic secondary anti-noise signal $y_m(n)$. The aim of the acoustic secondary anti-noise signal $y_m(n)$ is to be an opposite-phase image of the acoustic primary noise signal d(n). The degree to which the acoustic secondary anti-noise signal $y_m(n)$ matches the acoustic primary noise signal $d_m(n)$ determines the electrical error signal $e_m(n)$. If the acoustic primary noise signal and the acoustic secondary anti-noise signal were matched exactly, both in space and time, the primary noise signal would be completely eliminated at the control position and the electrical error signal $e_m(n)$ would be zero.

The system comprises a performance monitoring unit arranged to provide a respective modelled secondary anti-noise signal $\hat{y}_m(n)$, by providing a filter(s) $\hat{S}_{km}(w)$ that model(s) the respective secondary sound path(s), hereinafter referred to as secondary sound path model(s).

The performance monitoring unit is further arranged to calculate a respective mean correlation coefficient $\gamma_m(n)$ between the respective electrical error signal $e_m(n)$ and the respective modelled secondary anti-noise signal $\hat{y}_m(n)$ and optionally to calculate an average value $\gamma(n)$ of the mean correlation coefficients $\gamma_m(n)$.

The monitoring unit, hence, measures in real-time the correlation between the respective electrical error signal(s) $e_m(n)$ and the respective modelled secondary anti-noise signal(s) $\hat{y}_m(n)$, that is the degree of dependence between the respective signals.

A secondary sound path model $\hat{S}_{km}$ used to provide a modelled secondary anti-noise signal $\hat{y}_m(n)$ represents a transfer function between an acoustic transducer and a sound sensor. It may be determined offline (when there is no disturbing acoustic noise signal) in a calibration step, or online (in presence of the disturbing acoustic noise signal), through so-called online secondary path modelling techniques.

Providing a modelled secondary anti-noise signal $\hat{y}_m(n)$ may comprise passing the electrical reference signal consecutively through a secondary sound path model $\hat{S}_{km}$ and then through the filter W.

Alternatively, providing a modelled secondary anti-noise signal $\hat{y}_m(n)$ may comprise passing the electrical reference signal consecutively through the filter W and then through a secondary sound path model $\hat{S}_{km}$.

A mean correlation coefficient with a value of 0 indicates that the electrical error signal and the modelled secondary anti-noise signal are not correlated. A mean correlation coefficient with a value of 1 indicates that the signals are perfectly correlated.

A mean correlation coefficient $\gamma$ may be computed from a correlation coefficient defined as e.g. the Pearson correlation coefficient (PCC)

$$r: \frac{\mathrm{cov}(e, \hat{y})}{\mathrm{var}(e)\mathrm{var}(\hat{y})}, \tag{1}$$

wherein e is an electrical error signal and $\hat{y}$ is a modelled secondary anti-noise signal.

A mean correlation coefficient may be calculated from a function of a current correlation coefficient r(n) and a mean correlation coefficient at a previous time step $\gamma(n-1)$, wherein a correlation coefficient $r(n)$ is calculated from the N last samples of an error signal $e(n)$ and a modelled secondary anti-noise signal $\hat{y}(n)$, wherein the number of samples N is in the range of 100-10000, preferably 500-5000.

r may be evaluated at the current time step n using the values $$\{e(n), e(n-1), \ldots, e(n-N+1); \hat{y}(n), \hat{y}(n-1), \ldots, \hat{y}(n-N+1)\} \tag{2}$$

as $$r(n) = \frac{\sum_{i=0}^{N-1} (e(n-i) - \text{mean}(e))(\hat{y}(n-i) - \text{mean}(\hat{y}))}{\sqrt{\sum_{i=0}^{N-1} (e(n-i) - \text{mean}(e))^2}\sqrt{\sum_{i=0}^{N-1} (\hat{y}(n-i) - \text{mean}(\hat{y}))^2}} \tag{3}$$

$$\text{where mean}(e) = 1/N \, \Sigma_{i=0}^{N-1} e(n-i) \tag{4}$$

and with a corresponding definition for $\hat{y}$. A larger N results in a more accurate determination of the correlation coefficient $r(n)$, whereas a smaller N makes it more reactive to time evolutions of the signals. The mean correlation coefficient $\gamma$ is then computed from the value of r and its past history using the recursive relation $$\gamma(n) = \frac{1}{1+\eta}(\eta\phi(r(n)) + \gamma(n-1)), \tag{5}$$

where $\eta \ll 1$ is an update coefficient determining the contribution of the current correlation coefficient r to the mean value $\gamma(n)$. A typical value for $\eta$ would be in the range of 0.0001-0.01. $\phi$ is a function of the form $\phi(x)=|x|^a$ or alternatively $\phi(x)=x^a$, where a is a positive integer. a affects the sensitivity of the mean correlation coefficient to small variations of r. A typical value for a would be 1 or 2.

The performance monitoring unit compares the mean correlation coefficient(s) $\gamma_m(n)$ or alternatively their average value $\gamma(n)$ with a first threshold value $\alpha$ and/or a second threshold value $\beta$. $\alpha$ and $\beta$ are typically in the range 0.01-0.3 and 0.4-0.9 respectively, the choice of values being determined by the operator during an initial training period in representative operating conditions.

If the amplitude of all the mean correlation coefficients $|\gamma_m(n)|<\alpha$ or alternatively the amplitude of their averaged value $|\gamma(n)|<\alpha$, this indicates an optimally performing system, in which the adaptive filter used is working optimally or at least close to optimally. The acoustic secondary anti-noise signal $y(n)$ then contributes fully to reduce the acoustic primary noise $d(n)$ at the control position. The electrical error signal $e(n)$ is then weakly or not at all correlated with the secondary anti-noise signal $y(n)$.

If a mean correlation coefficient $\gamma_m(n)\geq\beta$ or alternatively if the average value of the mean correlation coefficients $\gamma(n)\geq\beta$, this may be indicative of a diverging system. If an amplitude of the mean correlation coefficient $\gamma_m(n)\geq\beta$ or alternatively if an amplitude of the average value of the mean correlation coefficients $\gamma(n)\geq\beta$, this may be indicative of a diverging system. The filter used is not adapted and there is a divergent behavior of the adaptive filter. The acoustic secondary anti-noise signal $y(n)$ is then larger in amplitude than required to cancel the acoustic primary noise $d(n)$ at the control position and the electrical error signal $e(n)$ is highly correlated with the acoustic secondary anti-noise signal $y(n)$.

If the amplitude of all or some of the mean correlation coefficients is $\alpha\leq|\gamma_m(n)|<$62 or alternatively if the average value of the mean correlation coefficients $\alpha\leq|\gamma(n)|<\beta$, this may be indicative of a non-optimal system.

The acoustic secondary anti-noise signal then contributes partially to reducing the acoustic primary noise at the control position. The electrical error signal is partially correlated with the secondary anti-noise signal. Such situation may occur e.g. if there is a convergence to a local minimum that would not provide minimized electrical error signal.

Based on the comparison of a mean correlation coefficient $\gamma(n)$ with the threshold value(s), different measures may be taken, such as to update filter parameters, change the selection of transducer(s) and/or sound sensor(s) used in the method/system, change the secondary path model, end the method/switching off the system etc.

Figure 7:
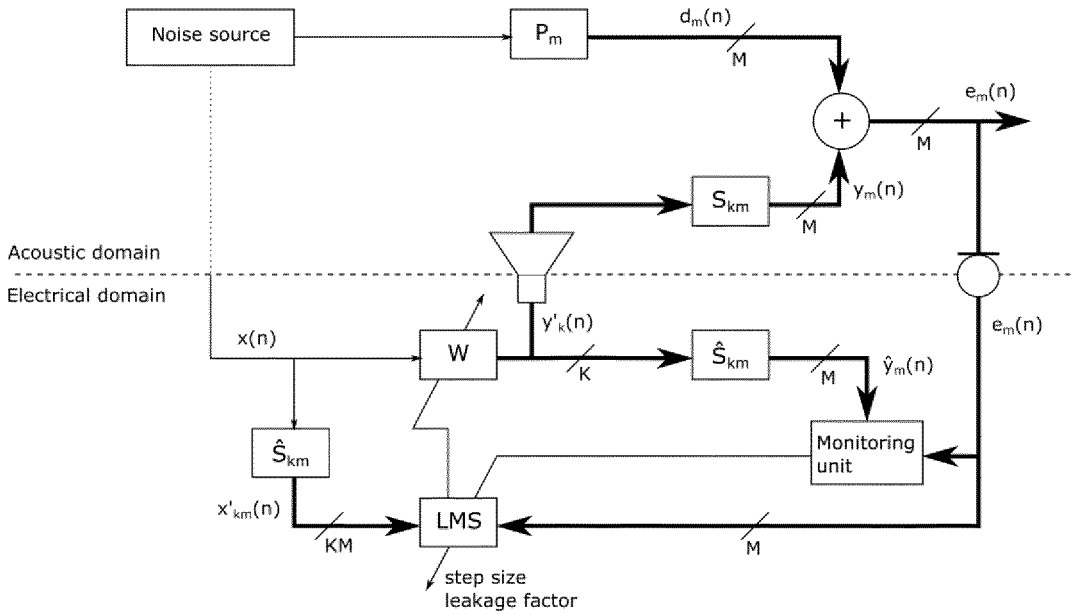
FIG. 7 shows a diagram of the active noise control system in FIG. 3, wherein the performance monitoring unit controls the step size and leakage factor of the LMS unit.

If a mean correlation coefficient $|\gamma_m(n)|>=\beta$ or alternatively if an average value of the mean correlation coefficients $\gamma(n)>=\beta$, the step size $\mu$ and the leakage factor of the adaptive algorithm may be corrected respectively by factors $\mu_{corr}(n)$ and $leak_{corr}(n)$ negatively dependent on the mean correlation coefficient. FIG. 7 shows such an algorithm in which the performance monitoring unit controls the values of step size and leakage factor of the LMS unit.

$\mu_{corr}(n)$ may be expressed as $\mu_{corr}(n)=1-\delta_\mu\,\gamma(n)$. $leak_{corr}(n)$ may be expressed as $leak_{corr}(n)=1-\delta_{leak}\,\gamma(n)$. Typical values for $\delta_\mu$ and $\delta_{leak}$ are 0.99 and 0.001, respectively.

An additional step of limiting the recovery rate of $\mu_{corr}(n)$, and $leak_{corr}(n)$, defined as the positive rate of change $\mu_{corr}(n+1)-\mu_{corr}(n)$, and $leak_{corr}(n+1)-leak_{corr}(n)$, respectively, to a respective maximal predetermined value may be implemented. The additional step may be used to prevent the step size, and/or the leakage factor, from recovering its initial value too fast, such that the system can have sufficient time to be stabilized. A typical value for the recovery rate may be a fifth of the sampling frequency.

Figure 8:
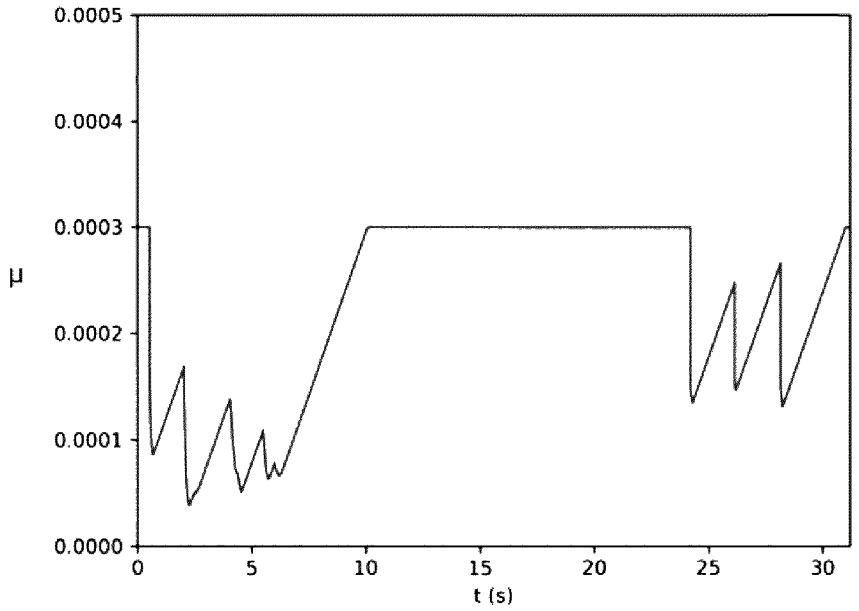
FIG. 8 shows an example of the evolution in time of the step size for a diverging active noise control system with a diverging control signal, when equipped with the performance monitoring unit as shown in FIG. 7.

FIG. 8 shows an example of the evolution of the step size $\mu$ during an application of the method. In this example, between 0.5 s and 6.5 s, the performance monitoring unit is repetitively detecting a divergence and the step size is reduced accordingly to prevent the divergence. Between 6.5 and 10 s, the step size is slowly recovering its initial value, with a limited recovery rate.

A distribution of acoustic transducers and sound sensors may be spatially optimal for a given noise disturbance, but may not be adapted when the noise disturbance changes or when the conditions in the compartment change. In such case, modifying this distribution may improve the performance of the system. Alternatively, a transducer/sensor may not be working properly, for example if it is defective or if it is covered by an object placed in the compartment. In such cases, deactivating it may result in a better control of the sound field.

Figure 2:
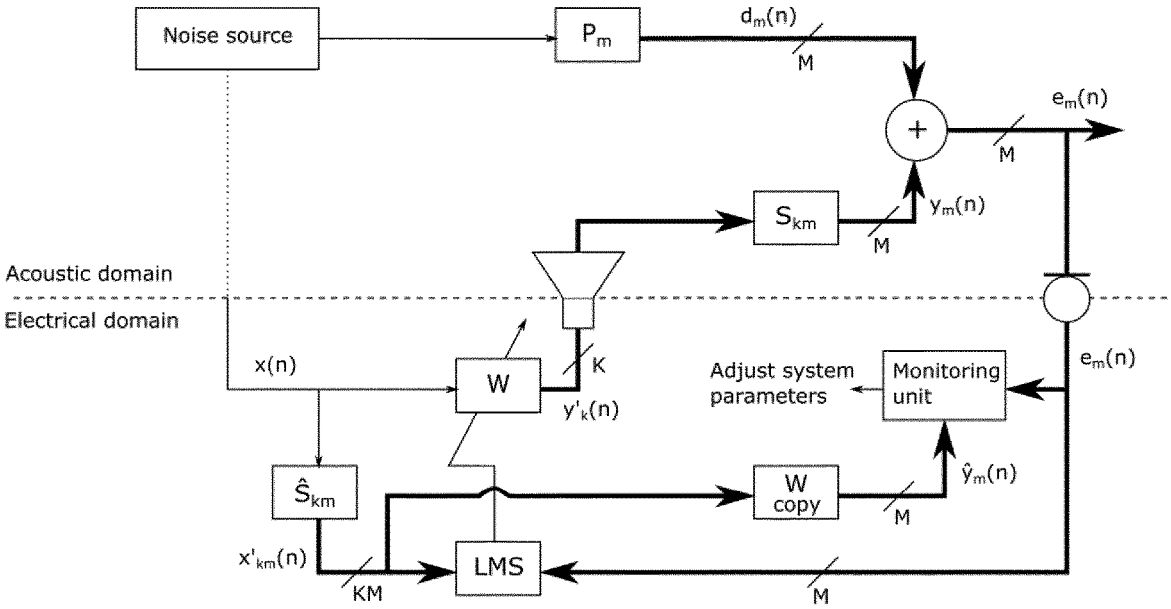
FIG. 2 shows a diagram of the active noise control system in FIG. 1 equipped with a performance monitoring unit implemented in an FXLMS adaptive control system.

In FIG. 2 is illustrated the performance monitoring unit implemented in the well-known filtered-X LMS (FXLMS) ANC system using K acoustic transducers and M sound sensors. An LMS adaptation unit is arranged to receive the electrical error signal(s) $e_m(n)$ and a filtered reference signal(s) $x'_{km}(n)$, which is (are) provided from the reference signal $x(n)$ after passing through the secondary path model(s) $\hat{S}_{km}$. The LMS adaptation unit controls the filter W, which receives the reference signal $x(n)$ and sends an electrical control signal(s) $y'_k(n)$ to the acoustic transducer, thus generating a secondary anti-noise signal $y_m(n)$ at the control position(s) via the secondary path(s) $\hat{S}_{km}$. The monitoring unit receives the error signal(s) $e_m(n)$ and the modelled secondary anti-noise signal(s) $\hat{y}_m$, which is (are) obtained from the filtered input(s) $x'_{km}(n)$ after passing through a copy of the filter W.

Figure 3:
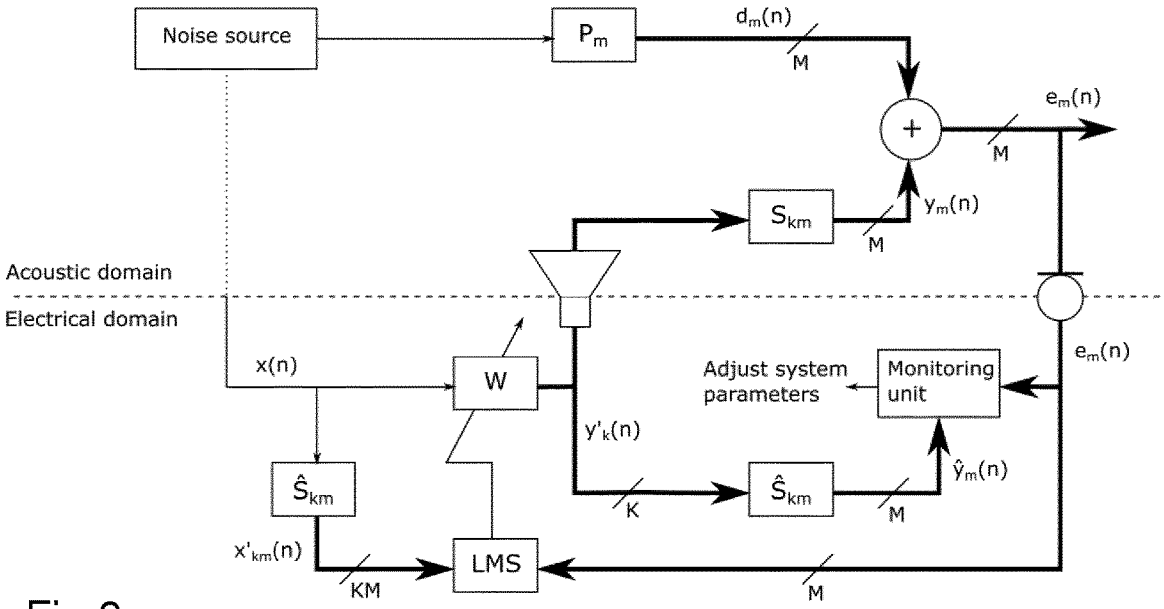
FIG. 3 shows a diagram of the active noise control system in FIG. 1 equipped with a performance monitoring unit implemented in an FXLMS adaptive control system, with an alternative implementation for the determination of the modelled control signal.

FIG. 3 shows an alternative implementation of the performance monitoring unit in a FXLMS system. Here, the modelled secondary anti-noise signal(s) $\hat{y}_m$ is (are) obtained from the electrical control signal(s) $y'_m(n)$, after passing through the secondary path model(s) $\hat{S}_{km}$.

Figure 5A:
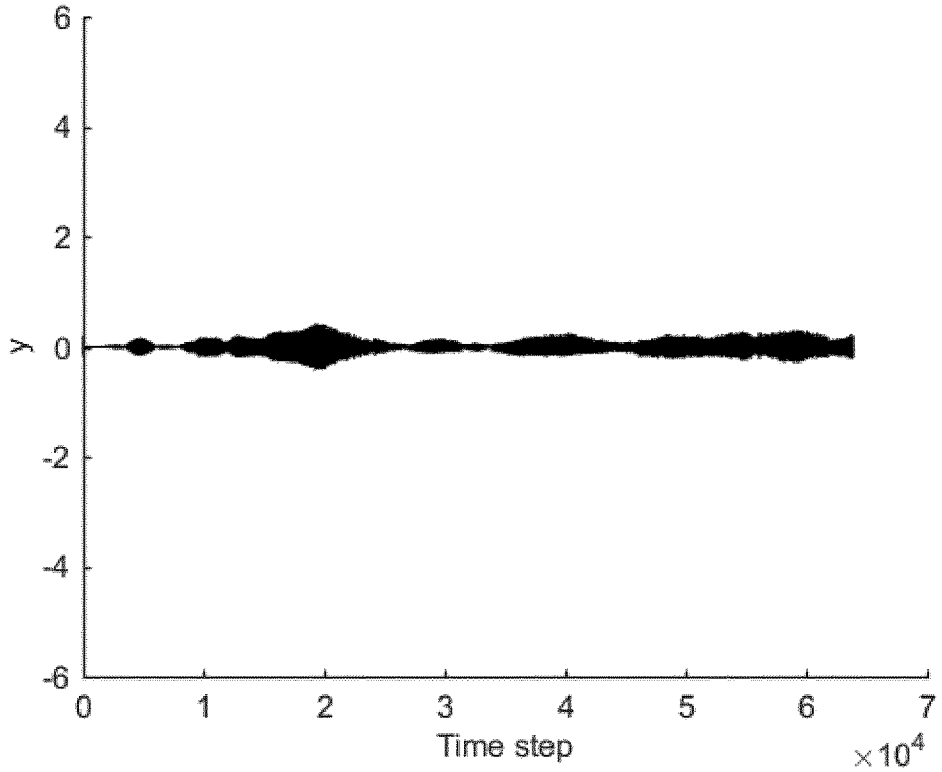
FIGS. 5*a* and 5*b* show an example of the evolution in time of the control signal and of the mean correlation coefficient for a stable active noise control system.
Figure 5B:
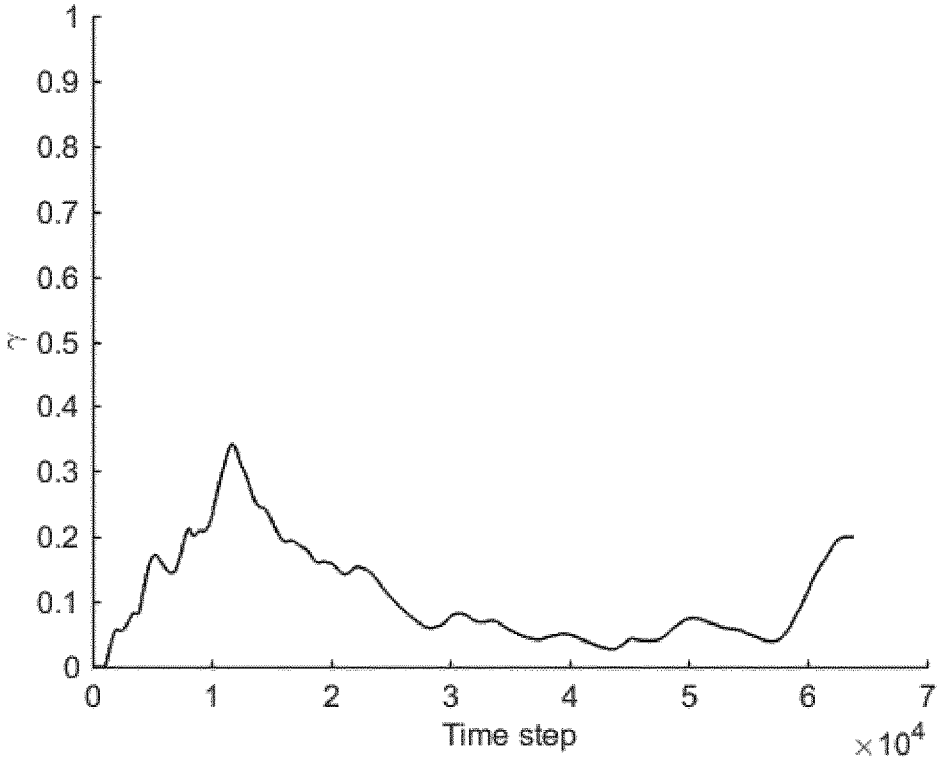

In FIGS. 5*a* and 5*b* is illustrated an example of a stable active noise control system. An anti-noise signal y(n) is shown in FIG. 5*a*, and the associated mean correlation coefficient γ(n) in FIG. 5*b*. In this example, N=1000, η=0, 0002, a=2 and the primary noise signal d(n) is time-varying. The values for γ remain small and the control may be qualified as optimal between 25 000 and 60 000 time steps, where γ<0.1.

Figure 6A:
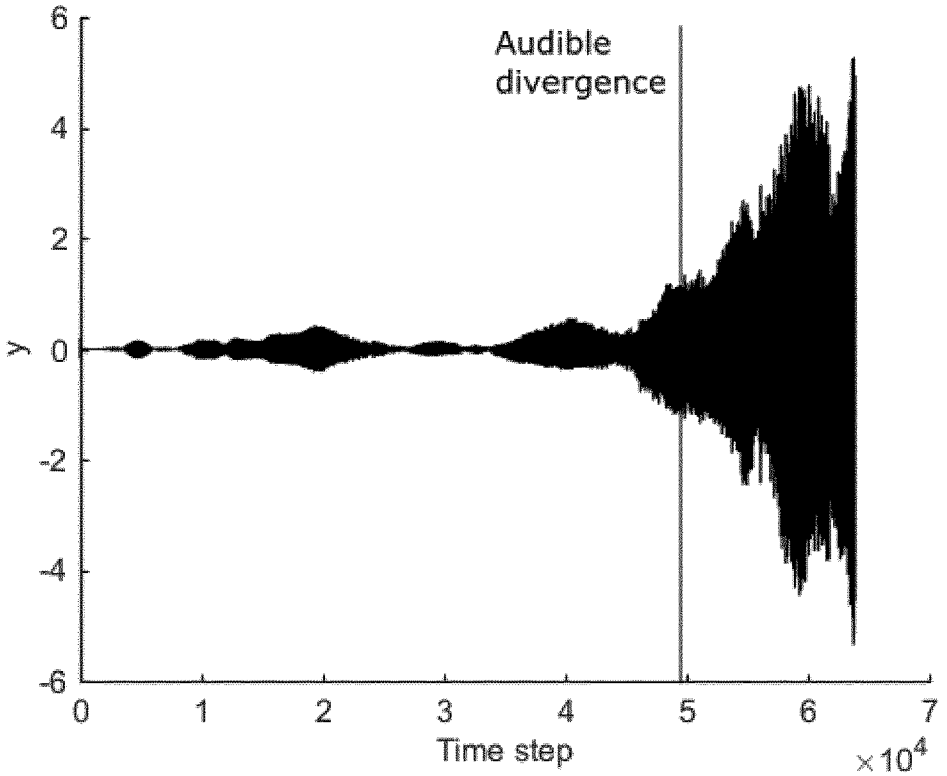
FIGS. 6*a* and 6*b* show an example of the evolution in time of the control signal and of the mean correlation coefficient for a diverging active noise control system with a diverging control signal.
Figure 6B:
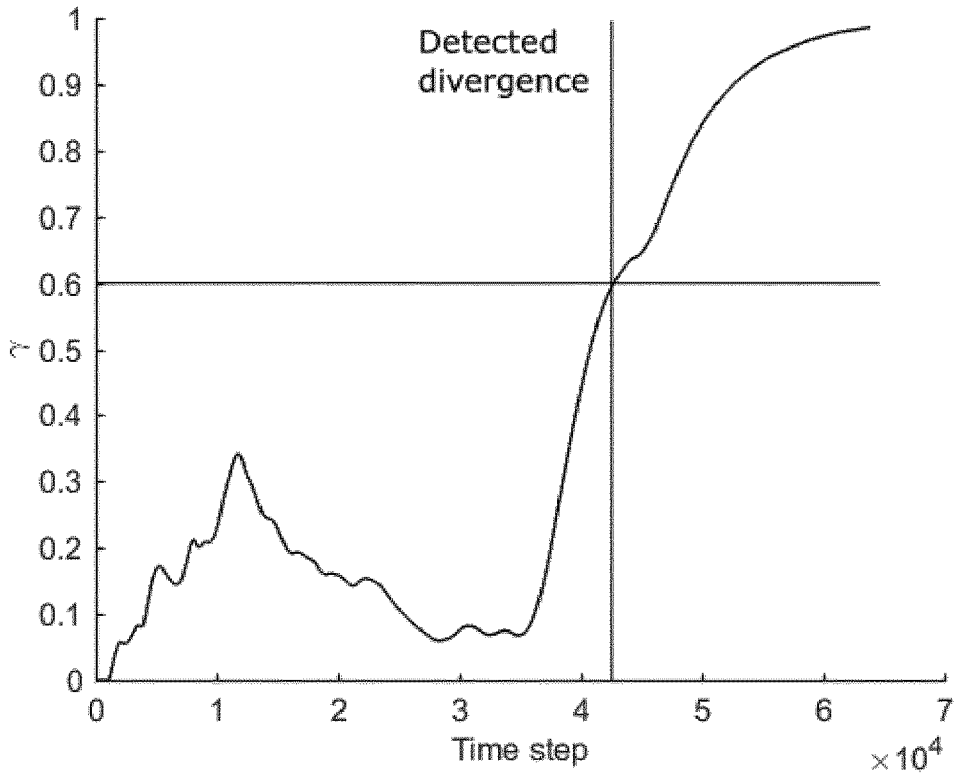

In FIGS. 6*a* and 6*b* is illustrated an example of a diverging active noise control system with a diverging secondary anti-noise signal y(n), FIG. 6*a*, and associated mean correlation coefficient γ(n), FIG. 6*b*. In this example N=1000, η=0.0002, a=2 and the mean correlation coefficient γ(n) has a relatively low value as long as the system remains stable. After about 35 000 time steps, the control signal starts diverging. By looking at the plot for y(n) alone, divergence is not clearly apparent before about 50 000 time steps. The plot for γ(n) on the other hand shows an apparent divergent behavior more than 10 000 steps earlier. On this example, by defining β as 0.6, divergence of the system can be detected near the onset of divergence, before it can be heard, which leaves enough time for the system to react and adjust its parameters.

Figure 4:
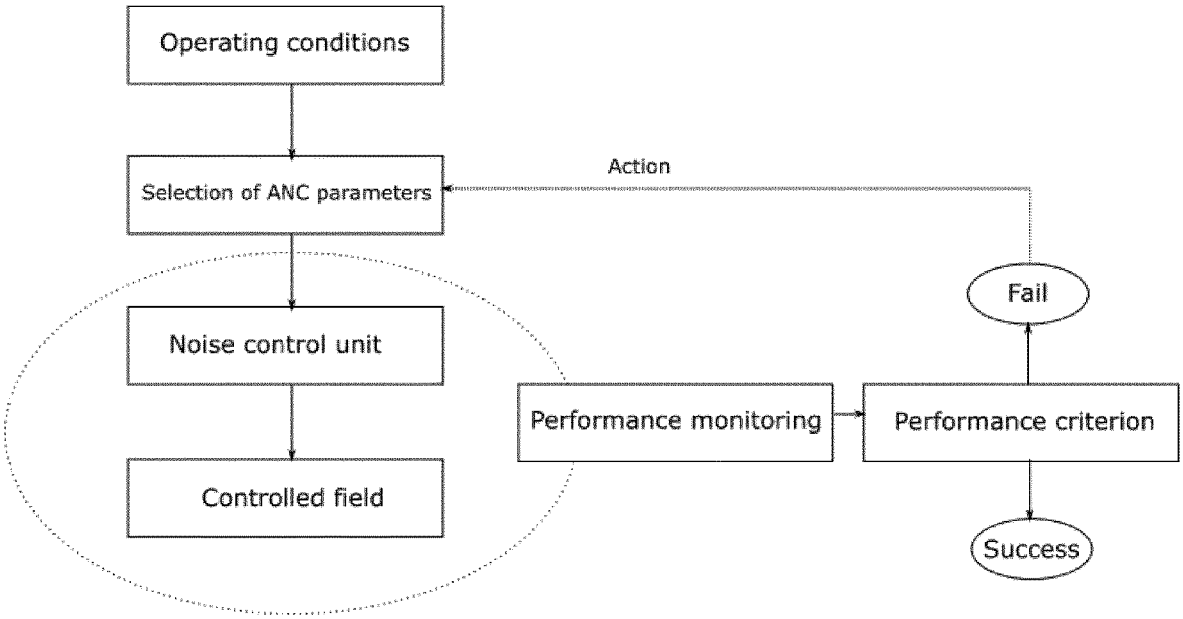
FIG. 4 shows a block diagram illustrating an active noise control system with a performance monitoring unit.

In FIG. 4 the active noise control system discussed above is shown as a block diagram. The performance monitoring unit is used in a supervisory loop to adjust the parameters of the active noise control system when divergent or non-optimal behavior is detected.

The invention claimed is:

1. A method for reducing the power of an acoustic primary noise signal ($d_m(n)$, m=1, 2, 3, . . . ) at one or more control positions in a vehicle passenger compartment, the acoustic primary noise signal originating from an acoustic noise signal transmitted from a noise source through a respective primary sound path ($P_m$, m=1, 2, 3, . . . ) to the respective control position, the method comprising:

arranging an adaptive filter to receive input signals comprising:

an electrical reference signal (x(n)) representing the acoustic noise signal, and at least one electrical error signal ($e_m(n)$, m=1, 2, 3, . . . ) representing a respective acoustic signal detected by a respective sound sensor at the respective control position, arranging the adaptive filter to provide and transmit at least one electrical control signal ($y'_k(n)$, k=1, 2, 3, . . . ) to at least one acoustic transducer arranged in the compartment, arranging the at least one acoustic transducer to, as a response to the at least one electrical control signal ($y'_k(n)$, k=1, 2, 3, . . . ), provide and transmit a respective anti-noise signal through a respective secondary sound path ($S_{km}$, k=1, 2, 3, . . . , m=1, 2, 3, . . . ) between the at least one acoustic transducer and the respective control position, arriving at the at least one control position as a respective acoustic secondary anti-noise signal ($y_m(n)$, m=1, 2, 3, . . . ), such as to minimize the respective electrical error signal ($e_m(n)$, m=1, 2, 3, . . . ), providing a respective modelled secondary anti-noise signal ($\hat{y}_m(n)$, m=1, 2, 3, . . . ) from a respective secondary sound path model ($\hat{S}_{km}$, k=1, 2, 3, . . . , m=1, 2, 3, . . . )

calculating a respective mean correlation coefficient ($\gamma_m(n)$, m=1, 2, 3, . . . ) between the respective electrical error signal ($e_m(n)$, m=1, 2, 3, . . . ) and the respective modelled secondary anti-noise signal ($\hat{y}_m(n)$, m=1, 2, 3, . . . ), and comparing at least one of the mean correlation coefficients ($\gamma_m(n)$, m=1, 2, 3, . . . ) with at least one predefined threshold (α, β), or comparing an average value (γ(n)) of the at least one correlation coefficient ($\gamma_m(n)$, m=1, 2, 3, . . . ) with at least one predefined threshold (α, β).

2. The method of claim 1, wherein providing a modelled secondary anti-noise signal ($\hat{y}(n)$) comprises passing an electrical reference signal (x(n)) consecutively through a secondary sound path model ($\hat{S}$) and then through the digital filter (W) of the adaptive filter.

3. The method of claim 1, wherein providing a modelled secondary anti-noise signal ($\hat{y}(n)$) comprises passing an electrical reference signal (x(n)) consecutively through the digital filter (W) of the adaptive filter and then through a secondary sound path model ($\hat{S}$).

4. The method of claim 1, wherein a mean correlation coefficient (γ(n)) at a current time step is calculated as a function of a correlation coefficient (r(n)) at the current time step and a mean correlation coefficient at a previous time step (γ(n−1)), wherein a correlation coefficient (r(n)) is calculated from the N last samples of an error signal (e(n)) and a modelled secondary anti-noise signal ($\hat{y}(n)$), wherein the number of samples N is in the range of 100-10000, preferably 500-5000.

5. The method of claim 1, wherein if an amplitude of at least one mean correlation coefficient ($\gamma_m(n)$, m=1, 2, 3, . . . ) or an amplitude of the average value (γ(n)) of the at least one mean correlation coefficient ($\gamma_m(n)$, m=1, 2, 3, . . . ) is smaller than a first threshold value α, this is indicative of an optimally performing method, wherein the first threshold value α is in the range of 0.01-0.3, preferably 0.05-0.2.

6. The method of claim 5, wherein vehicle operative conditions and method parameters are registered in a database when the method is performing optimally.

7. The method of claim 1, wherein if at least one of the mean correlation coefficients ($\gamma_m(n)$, m=1, 2, 3, . . . ) or the average value (γ(n)) of the at least one mean correlation coefficient ($\gamma_m(n)$, m=1, 2, 3, . . . ) is larger than or equal to a second threshold value β, this is indicative of a diverging method, wherein the second threshold value β is in the range of 0.4-0.9, preferably 0.5-0.8.

8. The method of claim 7, further comprising changing one or more filter parameters chosen from step size (μ), sign of step size (μ), phase of step size (μ) and leakage factor.

9. The method of claim 8, wherein at least one of the step size (μ) and leakage factor is changed by multiplication with a correction factor negatively dependent on the amplitude of the mean correlation coefficient.

10. The method of claim 8, wherein a recovery rate of at least one of a modified step size (μ) and leakage factor is limited to a predefined value.

11. The method of claim 7, further comprising changing a secondary sound path model ($\hat{S}_{km}$, k=1, 2, 3, . . . , m=1, 2, 3, . . . ) used in the method to a secondary sound path model selected from a set of pre-measured secondary sound path models.

12. The method of claim 7, wherein when two or more sound sensors are used in the method, the method further comprises changing a spatial distribution of acoustic transducers and/or sound sensors in the compartment by switching on or off one or more acoustic transducers and/or sound sensors.

13. The method of claim 7, further comprising a step of stopping the method.

14. The method of claim 1, wherein if at least one of an amplitude of the mean correlation coefficients ($\gamma_m(n)$, m=1, 2, 3, . . . ) or an amplitude of the average value ($\gamma(n)$) of the at least one mean correlation coefficient ($\gamma_m(n)$, m=1, 2, 3, . . . ) is larger than or equal to a second threshold value $\beta$, this is indicative of a diverging method, wherein the second threshold value $\beta$ is in the range of 0.4-0.9, preferably 0.5-0.8.

15. The method of claim 1, wherein if an amplitude of the at least one mean correlation coefficient ($\gamma_m(n)$, m=1, 2, 3, . . . ) or an amplitude of the average value ($\gamma(n)$) of the at least one mean correlation coefficient ($\gamma_m(n)$, m=1, 2, 3, . . . ) is larger than or equal to a first threshold value $\alpha$ and at least one of the mean correlation coefficients ($\gamma_m(n)$, m=1, 2, 3, . . . ) or the average value ($\gamma(n)$) of the at least one mean correlation coefficient ($\gamma_m(n)$, m=1, 2, 3, . . . ) is smaller than a second threshold value $\beta$, this is indicative of a non-optimally performing method, wherein the first threshold value $\alpha$ is in the range of 0.01-0.3, preferably 0.05-0.2, and the second threshold value $\beta$ is in the range of 0.4-0.9, preferably 0.5-0.8.

16. The method of claim 1, wherein if an amplitude of the at least one mean correlation coefficient ($\gamma_m(n)$, m=1, 2, 3, . . . ) or an amplitude of the average value ($\gamma(n)$) of the at least one mean correlation coefficient ($\gamma_m(n)$, m=1, 2, 3, . . . ) is larger than or equal to a first threshold value $\alpha$ and at least one of an amplitude of the mean correlation coefficients ($\gamma_m(n)$, m=1, 2, 3, . . . ) or an amplitude of the average value ($\gamma(n)$) of the at least one mean correlation coefficient ($y_m(n)$, m=1, 2, 3,...) is smaller than a second threshold value $\beta$, this is indicative of a non-optimally performing method, wherein the first threshold value $\alpha$ is in the range of 0.01-0.3, preferably 0.05-0.2, and the second threshold value $\beta$ is in the range of 0.4-0.9, preferably 0.5-0.8.

17. The method of claim 1, wherein the adaptive filter is a filter selected from a group consisting of filtered-x-LMS, leaky filtered-x-LMS, filtered-error-LMS and modified-filtered-x-LMS.

18. An active noise control system for reducing the power of an acoustic primary noise signal ($d_m(n)$, m=1, 2, 3, . . . ) at one or more control positions in a vehicle passenger compartment, the acoustic primary noise signal originating from an acoustic noise signal transmitted from a noise source through a respective primary sound path ($P_m$, m=1, 2, 3, . . . ) to the respective control position, wherein the system comprises:

an adaptive filter, which is arranged to take as input signals an electrical reference signal (x(n)) representing the acoustic noise signal, and at least one electrical error signal ($e_m(n)$, m=1, 2, 3, . . . ) representing a respective acoustic signal detected by a respective sound sensor at the respective control position, and which adaptive filter is arranged to provide and transmit at least one electrical control signal ($y'_k(n)$, k=1, 2, 3, . . . ) to at least one acoustic transducer arranged in the compartment, which at least one acoustic transducer in response to the at least one electrical control signal ($e_m(n)$, m=1, 2, 3, . . . ) is arranged to provide and transmit a respective acoustic anti-noise signal through a respective secondary sound path ($S_{km}$, k=1, 2, 3, . . . , m=1, 2, 3, . . . ) between the at least one acoustic transducer and the respective control position, arriving at the at least one control position as a respective acoustic secondary anti-noise signal ($y_m(n)$, m=1, 2, 3, . . . ), such as to minimize the respective electrical error signal ($e_m(n)$, m=1, 2, 3, . . . ), wherein the system further comprises a performance monitoring unit arranged to:

provide a respective modelled secondary anti-noise signal ($\hat{y}_m(n)$, m=1, 2, 3, . . . ) from a respective secondary sound path model ($\hat{S}_{km}$, k=1, 2, 3, . . . , m=1, 2, 3, . . . ), calculate a respective mean correlation coefficient ($\gamma_m(n)$, m=1, 2, 3, . . . ) between the respective electrical error signal ($e_m(n)$, m=1, 2, 3, . . . ) and the respective modelled secondary anti-noise signal ($\hat{y}_m(n)$, m=1, 2, 3, . . . ), and to compare at least one of the mean correlation coefficients ($\gamma_m(n)$, m=1, 2, 3, . . . ) with at least one predefined threshold ($\alpha$, $\beta$), or compare an average value ($\gamma(n)$) of the at least one correlation coefficient ($\gamma_m(n)$, m=1, 2, 3, . . . ) with at least one predefined threshold ($\alpha$, $\beta$).

* * * * *